US005447114A

United States Patent [19]

Korsgaard

[11] Patent Number: 5,447,114

[45] Date of Patent: Sep. 5, 1995

[54] METHOD AND APPARATUS FOR MOORING A VESSEL TO A SUBMERGED ELEMENT

[76] Inventor: Jens Korsgaard, 318 N. Post Rd., Princeton Junction, N.J. 08550

[21] Appl. No.: 248,048

[22] Filed: May 24, 1994

[51] Int. Cl.[6] ..... B63B 21/00

[52] U.S. Cl. ..... 114/230

[58] Field of Search ..... 114/230, 244 B, 219; 441/3, 4, 5

[56] References Cited

U.S. PATENT DOCUMENTS

| | | | |
|---|---|---|---|
| 3,588,796 | 6/1971 | Armistead | 114/144 B |
| 4,604,961 | 8/1986 | Ortloff et al. . | |
| 4,723,501 | 2/1988 | Hovden et al. | 114/144 B |
| 4,799,825 | 1/1989 | Meyerhoff et al. | 441/5 |
| 5,041,029 | 8/1991 | Kulpa | 114/144 B |

OTHER PUBLICATIONS

Innovative Disconnectible Mooring System for Floating Production System of HZ-21-1 Oil Field at Huizhou, South China Sea Copyright 1990, Offshore Technology Conference, paper presented at the 22nd OTC in Houston, Tex., May 7-10, 1990.

*Primary Examiner*—Stephen P. Avila
*Attorney, Agent, or Firm*—Kenyon & Kenyon

[57] ABSTRACT

A mooring system for a vessel including a mooring area on a bottom surface thereof, includes a mooring element coupled to the sea floor by a plurality of mooring tethers which resides, when not in use, in a storage position a preselected depth below the surface. An upper surface of the mooring element includes a sealing surface surrounding a target area to be coupled within the mooring area. The system includes apparatus for raising the mooring element from the storage position into a mooring position in which the sealing surface is in contact with the bottom surface of the vessel so that mooring area is sealed between the bottom surface of the vessel and the target area and a pump for lowering the pressure between the bottom surface of the vessel and the target area of the upper surface of the mooring element to a first level for immobilizing the mooring element with respect to the bottom surface of the vessel and a second level so that the mooring element is maintained in sliding contact with the bottom surface of the vessel. The system also includes a device for detecting a displacement of the mooring element from a desired position of the mooring element within the mooring area.

40 Claims, 3 Drawing Sheets

METHOD AND APPARATUS FOR MOORING A VESSEL TO A SUBMERGED ELEMENT

SUMMARY OF THE INVENTION

An object of the present invention is to provide a system which allows a buoy having an upper nearly flat surface to be moved in a controlled manner along the hull of a vessel using a differential hydrostatic pressure. Thus, allowing the buoy to be centered with respect to the mooring recess, without releasing the buoy from the bottom of the vessel.

Another object of the invention is to apply a force from the buoy's mooring chains in combination with the vessels propulsion system to supply the desired force vector to move the buoy along the bottom of the vessel in the desired direction.

The present invention is directed to a vessel mooring system including a mooring element coupled to the sea floor by a plurality of mooring tethers wherein, when not moored to a vessel, the mooring element is maintained in a storage position at a preselected depth below the surface, an upper surface of the mooring element including a sealing surface surrounding a target area to be coupled within the mooring recess, in combination with means for raising the mooring element from the storage position into a mooring position in which the sealing surface is in contact with the bottom surface of the vessel so that a sealed mooring area is created between the bottom surface of the vessel and the area surrounded by the sealing surface. A pump lowers the pressure between the bottom surface of the vessel and the upper surface of the mooring element to produce a first differential between the ambient pressure and the pressure in the mooring area for immobilizing the mooring element with respect to the bottom surface of the vessel and a second differential between the ambient pressure and the pressure in the mooring area so that the mooring element is maintained in sliding contact with the bottom surface of the vessel. The system includes means for detecting the displacement of the mooring element from a desired position of the mooring element on the bottom of the vessel.

The method of mooring a vessel to a mooring element according to the present invention includes the steps of positioning the vessel above the mooring element storage position and raising the mooring element into contact with the bottom surface of the vessel. The mooring element is then secured to the bottom surface of the vessel by reducing the hydrostatic pressure in a mooring area located between an upper surface of the mooring element and the bottom surface of the vessel so that a first differential is created between the pressure in the mooring area and the ambient pressure. Then the displacement of the mooring element from a desired position on the bottom of the vessel is determined and the vessel is moved, with the mooring element secured to the bottom surface of the vessel, so that a tension force, applied to the mooring element through the mooring tethers, is directed toward the desired position of the mooring element. The hydrostatic pressure within the mooring area is then increased until the differential between the hydrostatic pressure within the mooring area and the ambient pressure reaches a second differential, so that the mooring element slides along the bottom surface of the vessel toward the desired position of the mooring element. Upon reaching the desired position, the pressure within the mooring area is rapidly reduced to create a third differential between the hydrostatic pressure within the mooring area and the ambient pressure to secure the vessel to the mooring element in the desired position.

DETAILED DESCRIPTION

Figure 1:
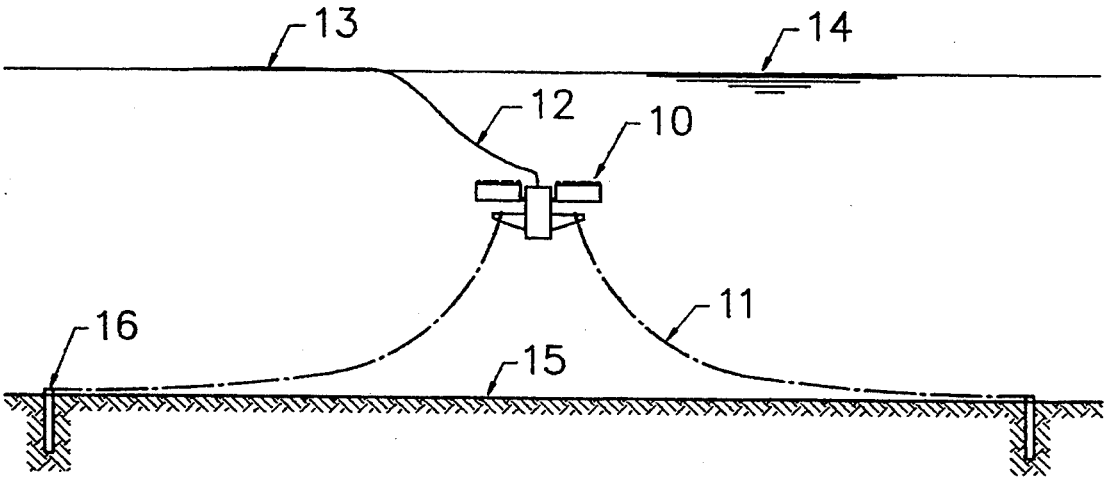
FIG. 1 shows a side view of a buoy according to a first embodiment of the present invention wherein the buoy is in a submerged position.

FIG. 1 shows a submerged buoy 10 which floats in an equilibrium position below the surface of the sea at an elevation such that the downward force from the mooring chains 11 exactly equals the net upward buoyancy of the buoy 10. The buoy 10 is equipped with a retrieval line 12 which is buoyant an upper portion 13 of which floats on the surface 14 of the sea. The submerged buoy 10 is moored to the sea bed 15 through a series of radially deployed mooring chains or ropes 11, each of which is coupled to a respective anchor 16 mounted in the sea bed.

The upper portion 13 of the line 12 is adapted to be retrieved by a vessel 30 and coupled to a lifting device such as a winch (not shown) aboard the vessel 30. When an upward pull is applied to the retrieval line 12 from the lifting device, the mooring chains 11 are lifted off the sea bed 15 and the buoy 10 is raised toward the bottom of the vessel 30. The process of mooring the vessel 30 to the buoy 10, once the buoy 10 is located adjacent to the bottom of the vessel 30 will be identical in regard to the buoy 10 according to the first and second embodiments. This operation will be described in detail with reference to FIGS. 3–6, following the description of the buoy 10 according to the second embodiment.

Figure 2:
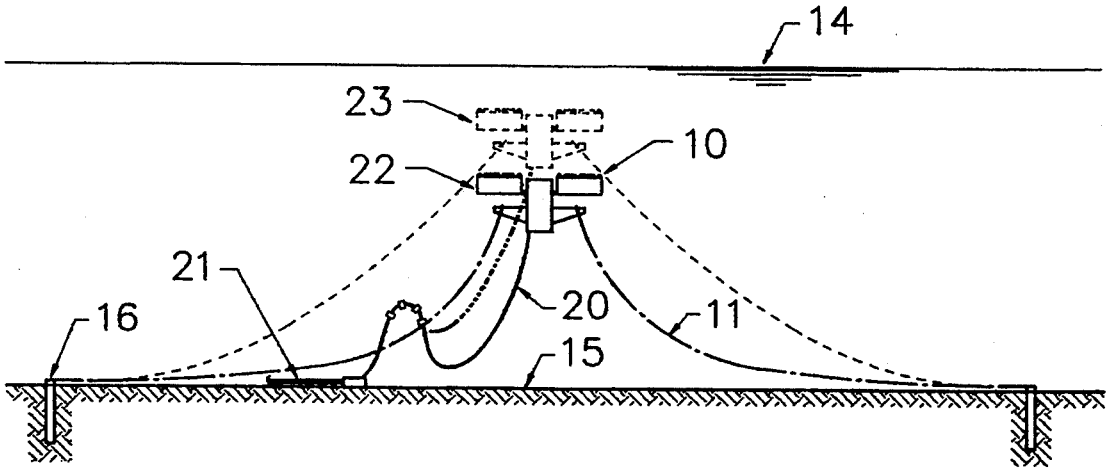
FIG. 2 shows a side view of a buoy according to a second embodiment of the present invention wherein the buoy is in a submerged position.

FIG. 2 shows an alternative submerged buoy 10 similar to the buoy 10 shown in FIG. 1 except that this buoy 10 includes no retrieval line. This buoy 10 may be supplied with compressed air by means of a riser 20 connected through a sub-sea pipeline 21 to a remote source (not shown) of compressed air. Alternatively, the buoy 10 may be fitted with compressed air storage tanks (not shown) which may be recharged each time a vessel 30 is moored to the buoy 10. The buoy 10 floats in its stowed position 22 at a level below the keel of passing ships. As known in the art, a vessel 30 may position itself above the buoy 10 using data from a geopositional satellite in reference to a known fixed position. When a vessel 30 is in position for mooring, the buoy 10 may be raised toward the bottom of the vessel 30 by transmitting a sonar signal to a receiver on the buoy 10 causing the expulsion of water ballast from the buoy 10 with the aid of compressed air. The resultant increase in the net buoyancy of the buoy 10 causes the buoy 10 to lift additional lengths of the mooring chains 11 off the sea bed and rise to a mooring position 23 in which an upper surface of the buoy 10 engages the bottom of the vessel 30.

More specifically, as the vessel 30 approaches the buoy 10, a signal is sent to the buoy 10 controlling the buoy 10 to rise in the water column until the buoy 10 reaches a premooring depth a short distance below the draft of the vessel 30. The premooring depth is typically from one to three meters below the draft of the ship. Those skilled in the art will understand that the premooring depth will be selected to be a greater distance below the draft of the vessel in rough seas and that, in relatively calm seas, the premooring depth may be relatively close to the draft of the vessel 30. Thereafter, the buoy 10 is signalled to rise the rest of the distance to the bottom surface of the vessel 30 when, taking account of the drift of the vessel 30, it is calculated that the buoy 10 will contact the bottom of the vessel 30 directly below the intake 32. The buoy 10 will typically rise from the premooring depth at approximately 0.05 to 0.3 meters per second depending upon the final buoyancy of the buoy 10. Thus, the buoy 10 will contact the bottom surface of the vessel 30 between 3 and 60 seconds after the final deballasting has commenced. The securing of the buoy 10 to the vessel 30 by the first pressure differential typically lasts between 2 and 8 seconds and the entire mooring process may be completed within 5 seconds although the mooring process may take more than one minute. The short time required for the mooring process makes it possible to moor even if the propulsion system of the vessel 30 is incapable of maintaining the vessel 30 in position above the buoy 10 within the required tolerance which is typically between 5 and 10 meters. That is, the command to bring the buoy 10 up from the premooring depth may be issued the required number of seconds before the intake 32 passes over the buoy 10 so that the intake 32 will be wholly within the exterior sealing surface 17 of the buoy 10. In the event that the vessel 30 cannot be adequately controlled and the buoy 10 slides off the bottom of the vessel 30, the vessel 30 is moved away from the mooring position and a signal is sent to the buoy 10 causing the buoy 10 to reballast to at least the premooring depth. When the buoy has stabilized at the desired depth the mooring process is attempted again. If the supply of compressed air for the buoy 10 is depleted during repeated mooring attempts, a service vessel may resupply the buoy 10.

Those skilled in the art will recognize that the buoy 10 may be equipped with both a deballasting system as described above and a retrieval line. Thus, reducing the force to which the retrieval line is subjected. The deballasting system may be activated by a sonar signal as described above or, alternatively, may be activated by the upward force on the retrieval line.

Figure 3:
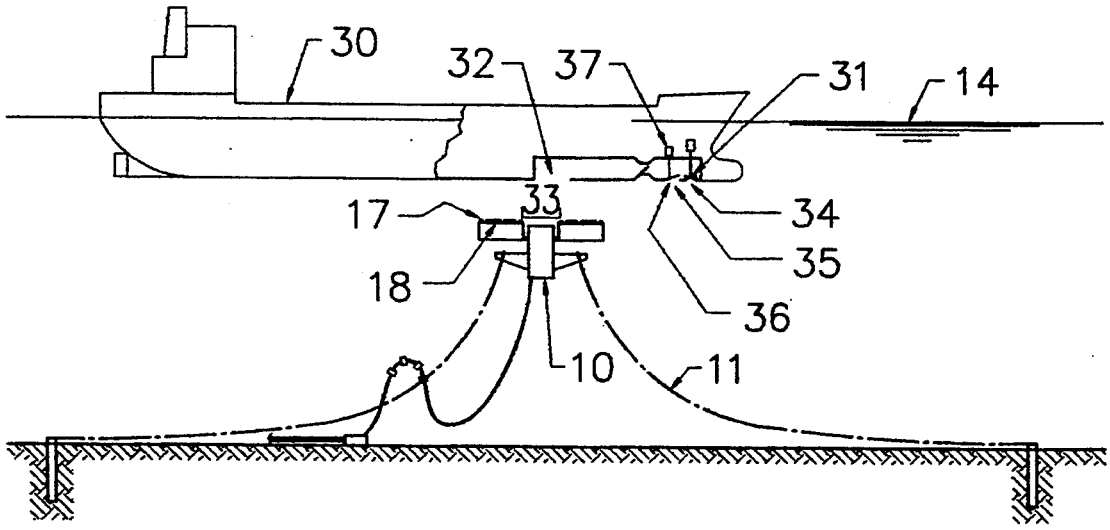
FIG. 3 shows a side view of a buoy according the present invention in approaching the bottom of a vessel to which it is to be coupled.

FIG. 3 shows a vessel 30 in the process of mooring to a buoy 10 of the type shown in FIG. 2 which has previously been raised to the mooring position 23. The vessel 30 is equipped with a pump 31 which has an intake 32 within the area 33 on the bottom of the vessel 30 in which it is desired to moor the buoy 10. The pump 31, which is preferably a high volume, low head pump, discharges water back to the sea at one or more discharge ports 34 remote from the area 33. Each of the discharge ports 34 may be equipped with a deflector to direct the discharge jet such that the pump 31 may, through its one or more discharge ports 34, apply a thrust force in a desired direction. The pump 31 is also equipped with a second intake 35 remote from the area 33. The second intake 35 is equipped with a valve 36 which is used to regulate the flow through the second intake 35. The valve 36 is opened and closed by a powered actuator 37 and is remotely controlled by the crew of the vessel 30.

When the vessel 30 approaches the mooring site above the buoy 10, the valve 36 is closed and the pump 31 draws water only through the intake 32. As stated previously, the position of the vessel 30 can be determined with a high degree of accuracy using satellite and/or sonar data, so that the vessel can be positioned directly above the buoy 10. The buoy 10 is then raised into contact with the bottom of the vessel 30 so that the intake 32 is completely within the exterior seal 17 on upper surface of the buoy 10. The pump 31 is then drawing water from the closed volume isolated by the closed valve 36, and the buoy 10. This forces the buoy 10 onto the bottom of the vessel 30 until the seals 17 and fenders 18 are compressed until the compressive force between the hull of the vessel 30 and seals 17 and the fenders 18 of the buoy 10 equals the force from the combination of the net buoyancy of the mooring system and the differential hydrostatic pressure acting between the underside and the top of the buoy 10. A minimum pressure on top of the buoy 10 is reached at the cavitation suction pressure of the pump 31. To regulate the pressure at the top of the buoy 10, the valve 36 at the intake 35 may be partly or fully opened permitting water to flow both to the pump 31 and back to the top of the buoy 10 through the intake 32. This raises the hydrostatic pressure reducing the force acting to compress the fenders 18 and the seals 17 on the buoy 10 against the hull of the vessel 30. As the compressive force acting on the fenders 18 and the seals 17 is reduced, the friction force acting to resist horizontal movement of the buoy 10 along the bottom of the vessel 30 is also reduced and forces applied to the buoy from the mooring chains 11 may move the buoy 10 along the bottom surface of the vessel 30.

Figure 4:
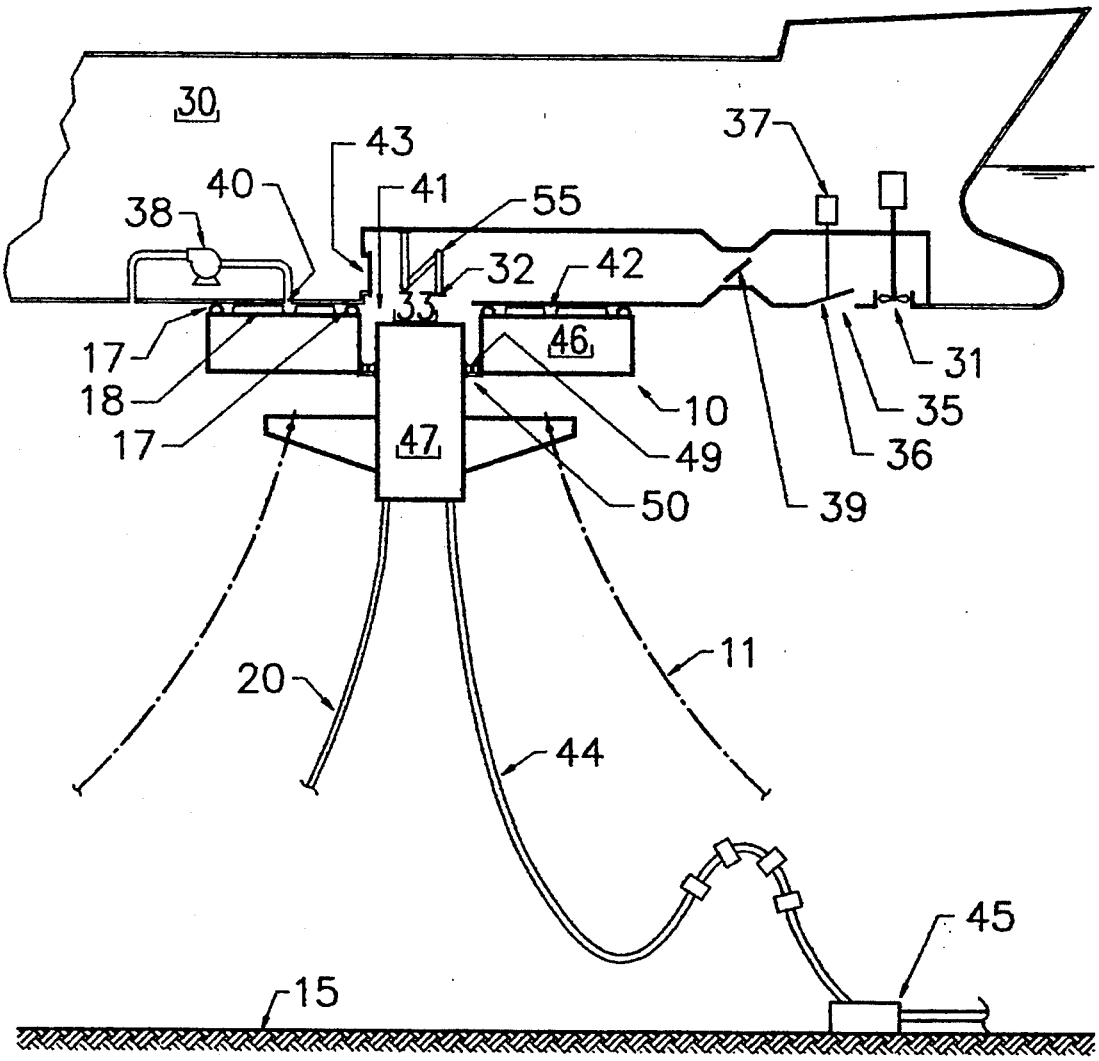
FIG. 4 shows a side view of a buoy according the present invention in a position adjacent to the bottom of a vessel to which it is to be coupled.

FIG. 4 shows the buoy 10 moored to the vessel 30 in more detail. As stated above, the upper surface of the buoy 10 is furnished with a number of fenders 18 and seals 17. The seals 17 are pliable continuous seals deployed concentrically around the center of the buoy 10. The seals 17 may preferably be formed of polyethylene or teflon. The buoy 10 is at least equipped with at least one seal 17 and may have several such seals 17. The seals 17 typically protrude further above the top surface of the buoy 10 than do the fenders 18. This ensures that sufficient pressure is exerted on the seals 17 to make the coupling between the bottom of the vessel 30 and the buoy 10 substantially watertight. The fenders 18 serve 3 purposes: 1) they cushion the bottom of the vessel 30 protecting the surface from vertical impacts of the buoy 10 during mooring attempts in high waves; 2) when the buoy 10 is moored to the vessel 30, they distribute the large compressive forces between the buoy 10 and the vessel 30; and 3) they provide friction between the vessel 30 and the buoy 10 when the buoy 10 is securely moored to the vessel 30 so that the buoy 10 does not move along the bottom of the vessel 30 when acted upon by the mooring forces from the vessel 30.

When the buoy 10 has been secured to the bottom of the vessel 30 by means of the suction from the pump 31, the buoy 10 is securely attached as long as the pump 31 continues to pump. In order to reduce the power consumed by the pump 31, a second pump 38 having a lower suction pressure and a significantly smaller volumetric capacity than the pump 31 may be engaged. This allows the pressure between the bottom of the vessel 30 and the buoy 10 to be reduced relative to the pressure obtainable with a system employing only one pump 31. In this case, the valve 39 is closed between the pump 31 and the intake 32. This enables the pump 31 to be shut down. In the alternative, the valve 35 may be opened fully and the pump 31 may continue to work as a thruster to affect the mooring loads on the buoy 10.

In the event that two or more concentric seals 17 are furnished on the buoy 10, the second pump 38 may be provided with an intake 40 so that the pressure in an area 42 between the seals 17 is lowered. It may be desirable to lower this pressure to the vapor pressure of sea water. Because the center of the buoy 10 is isolated from the low pressure area 42 by the inner seal 17, the center volume 41 may be dewatered using a bilge pump (not shown) and atmospheric air may be admitted to the center volume 41. The center volume 41 may be further provided with a personnel access hatch 43 allowing personnel to access the center volume 41 in order to connect fluid connectors 55 for cargo transfer via the riser 44 from a pipeline 45 on the sea bed, for connecting structural mooring ropes (not shown) between the buoy 10 and the vessel 30, or for performing maintenance operations on the buoy 10. As known in the art, the fluid connectors 55 will usually be remotely coupleable to the fluid connectors on the buoy 10. When personnel are not required to couple the fluid connectors 55 to the fluid connectors on the buoy 10, the volume 41 may be maintained flooded with water or with inert gas to reduce the risks associated with leaking oil or gas combining with the air in the volume 41 to form an explosive combustible mixture.

It is preferable that the moored vessel 30 be permitted to weather vane about a vertical axis while moored to the buoy 10. While moored, the vessel may, in response to shifting winds, currents and waves, make one or more complete revolutions. For the purpose of enabling the vessel 30 to whether vane, the buoy 10 is comprised of two parts 46 and 47 separated by a vertical axis structural bearing 49. One or more seals 50 are provided between the two parts 46 and 47 of the buoy 10 to prevent the ingress of sea water into the center volume 41 above the buoy 10. While coupled securely to the vessel 30, the part 46 remains stationary with respect to the vessel 30, rotating with the vessel 30 as it weathervanes about a vertical axis. Meanwhile, the part 47 does not rotate with respect to the sea bed 15. In addition, the fluid connectors 55 include swivels so that the piping in the vessel 30 may rotate about a vertical axis relative to the piping in the part 47 of the buoy 10.

As stated above, the seals 17 preferably protrude above the fenders 18 and are made of a material having a low coefficient of friction in conjunction with the bottom plating of the vessel 30. In contrast, the fenders 18 are preferably made from a material having a very high coefficient friction in conjunction with the bottom plating of the vessel 30. The fenders 18 may preferably be made of the standard rubber material used for the production of known docking fenders and may also be made of material similar to that of which automobile tires are constructed.

Figure 5:
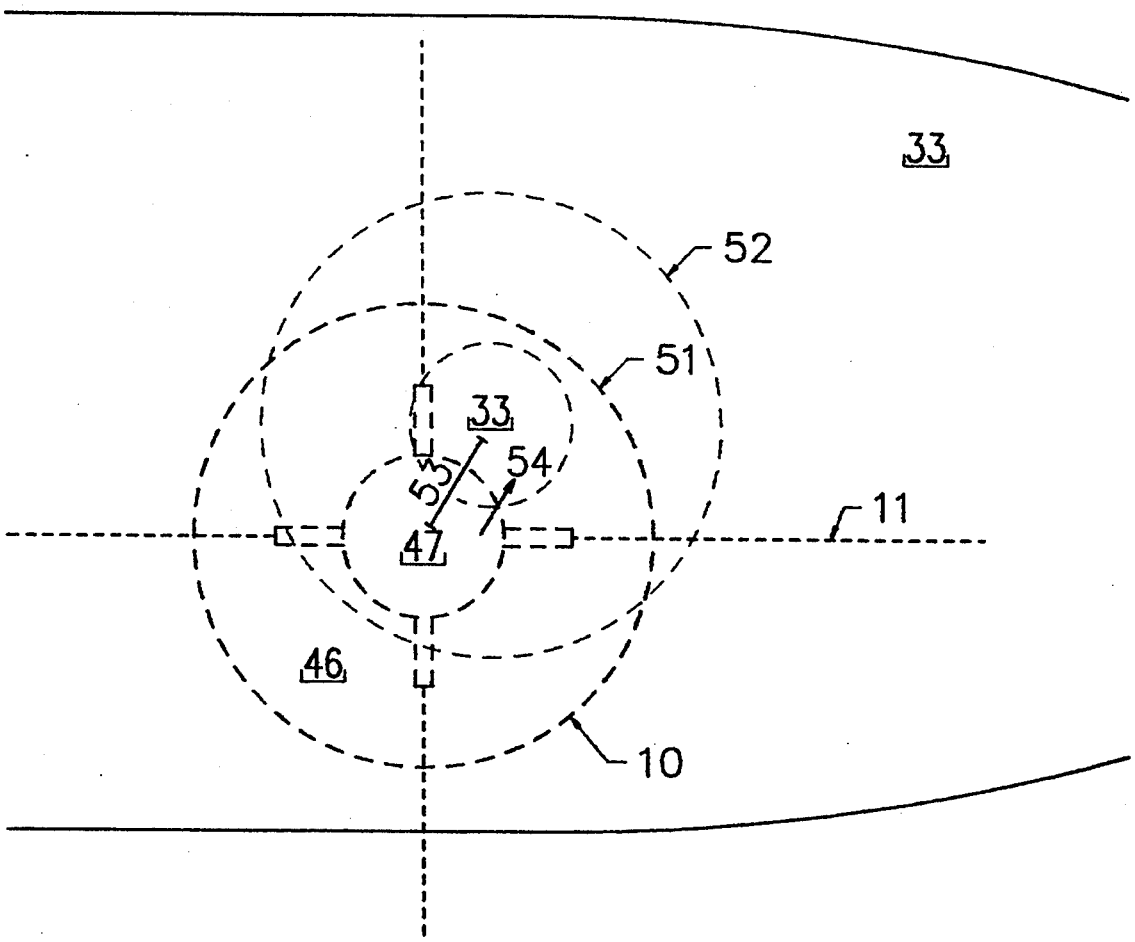
FIG. 5 shows a bottom view of a buoy according to the present invention in an off-center position on the bottom of a vessel to which it is to be coupled.

FIG. 5 shows a plan view of the bottom of the vessel 30 illustrating how the buoy 10 is moved along the bottom of the vessel 30 without being disconnected therefrom.

In FIG. 5 the vessel 30 is seen from below with the buoy 10 attached eccentrically in an off-center position 51 with respect to the intake 32. To effect the fluid connection between the buoy 10 and the vessel 30, it is necessary to move the buy 10 to a position 52 which is centered. More specifically, for a buoy 10 having a single fluid connection to the vessel 30, it is necessary to position the buoy 10 so that its center is within approximately $0.8^{x}r$ of the center of the intake 32, where r is the radius of the intake 32. In order to properly position the buoy 10, it must be moved the distance 53 in the direction 54, relative to bottom of the vessel 30. Initially, the main propulsion machinery and the bow thruster on the vessel 30 are employed to deflect the vessel 30 and the buoy 10 in a direction opposite to direction 54, thus imparting a tension in the mooring chains 11 in the direction 54. When the amount of deflection in this direction is sufficient to create a desired tension in the mooring chains 11, the hydrostatic pressure between the vessel 30 and the buoy 10 is raised, as explained for FIGS. 3 and 4, until the buoy 10 starts slipping along the bottom of the vessel 30 in the direction 54. As the slip distance approaches the distance 53, the pressure above the buoy 10 is quickly lowered and the slippage stops. If this procedure is not successful it may be repeated with different values of the direction 54 and distance 53 until the centered position 52 is achieved within the required tolerance. The differential between the ambient pressure and the pressure in the area between the buoy 10 and the bottom surface of the vessel 30 is preferably increased to between 10 and 100 kPa immediately following contact between the buoy 10 and the vessel 30. In order to move the buoy 10 along the bottom surface of the vessel 30, the hydrostatic pressure differential is reduced to between 2 and 50 kPa. When the buoy 10 has been centered in the desired position, the vessel 30 is moored to the buoy 10 by increasing the hydrostatic pressure differential to between 60 and 300 kPa. Those skilled in the art will recognize that the actual pressure differential employed will depend in each case on the diameter of the buoy 10 and on the draft of the vessel 30.

Those skilled in the art will recognize that the position of the buoy 10 with respect to the center of the intake 32 may be determined visually by directly viewing the buoy 10 through a window formed in the personnel access hatch 43 or by using an underwater television camera to observe either concentric circles formed on the upper surface of the buoy 10 or one or more lights mounted on the upper surface of the buoy 10. Alternatively, the buoy 10 may include an acoustic transponder (not shown) which transmits signals to sensors (not shown) mounted on the bottom surface of the vessel 30.

Figure 6:
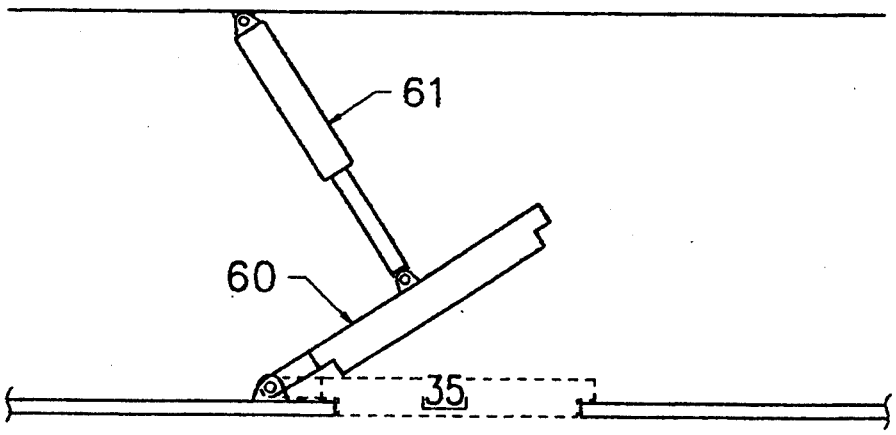
FIG. 6 shows a side view of an intake for the pump which is remote from the mooring area.

FIG. 6 shows a detailed view of the intake 35 in which the intake 35 is closed by a hatch 60 which, at the same time, serves as a pressure control valve. The opening of the hatch 60 is controlled by a mechanical system such as a hydraulic cylinder 61 which may completely close the hatch 60 when the vessel 30 is underway and which may maintain the hatch 60 in any position between fully opened and completely closed. The cylinder 61 may further be coupled to a servo system (not shown) to automatically maintain the degree of opening required to achieve a selected pressure for which the servo system is set.

The intake 32 may be equipped with a similar hatch (not shown) for the purpose of maintaining a hydrodynamically streamlined hull of the vessel 30 to reduce its flow resistance when underway.

Thus, after determining the direction and extent of the displacement of the buoy 10 from the center of the intake 32, the mooring system according to the present invention applies the propulsive power of the vessel 30 in combination with forces from the wind, current, and waves so that the vessel 30 and the buoy 10 deflect in a direction which is opposite to the desired direction 54 of the movement of the buoy 10 along the bottom of the vessel 30. When a desired level of restoring force in the mooring system has been achieved as determined by the deflection of the buoy 10 from its natural or equilibrium position, the hydrostatic pressure above the buoy 10 is rapidly raised thereby reducing the compression force between the buoy 10 and the vessel 30 which in turn reduces the friction force between the buoy 10 the bottom of the vessel 30. In consequence the buoy 10 will slip along the bottom of the vessel 30 in the direction of the neutral position of the buoy 10.

This motion reduces the elastic restoring force acting on the buoy 10 thereby causing the slippage to stop a short distance after it started. The buoy 10 may be stopped in any position by rapidly lowering the hydrostatic pressure above the buoy 10 as the buoy 10 approaches the desired position.

Through repeated application of these steps, the buoy 10 may be moved to any location as long as the intake 32 remains wholly within the exterior sealing surface 17 while remaining securely attached to the vessel 30.

Those skilled in the art will recognize that maintaining a uniform hydrostatic pressure will be enhanced by providing a bottom surface of the vessel 30 which is relatively free from marine growth.

The embodiments described above are presented for the purposes of illustration and are not intended to limit the scope of the invention. Those skilled in the art will recognize that many variations may be made to the described embodiments without departing from the scope of the invention which is to be limited only by the claims appended hereto.

What is claimed is:

1. A method of mooring a vessel to a mooring element coupled to the sea floor by a plurality of mooring tethers wherein, when not coupled to a vessel, the mooring element is maintained in a storage position a preselected depth below the surface of the sea, wherein a bottom surface of the vessel includes a mooring area, the method comprising the steps of:

positioning the vessel above the mooring element storage position;

raising the mooring element into contact with the bottom surface of the vessel;

securing the mooring element to the bottom surface of the vessel by reducing the hydrostatic pressure in the mooring area between an upper surface of the mooring element and the bottom surface of the vessel so that a first differential is created between the pressure in the mooring area and the ambient pressure;

detecting a displacement of the mooring element from a desired position of the mooring element within the mooring area;

moving the vessel, with the mooring element secured to the bottom surface of the vessel, so that a tension force, which is applied to the mooring element through the mooring tethers, is directed toward the desired position of the mooring element;

increasing the hydrostatic pressure within the mooring area until the differential between the hydrostatic pressure within the mooring area and the ambient pressure reaches a second differential, wherein the second differential is less than the first differential, so that the mooring element slides along the bottom surface of the vessel toward the desired position of the mooring element; and rapidly reducing the pressure within the mooring area when the mooring element reaches the desired position within the mooring area to create a third differential between the hydrostatic pressure within the mooring area and the ambient pressure to secure the vessel to the mooring element in the desired position.

2. A method according to claim 1, wherein the displacement of the mooring element from the desired position is detected visually via an optical imaging device.

3. A method according to claim 1, wherein the mooring element is raised into contact with the vessel by drawing a retrieval line which is coupled to the mooring element aboard the vessel until the mooring element contacts the bottom surface of the vessel.

4. A method according to claim 1 wherein the mooring area in which the hydrostatic pressure is reduced is an annular space which surrounds a fluid coupling between the mooring element and the vessel so that, after the mooring element has been secured in the desired position within the mooring area, water may be removed from the central volume inside the annular mooring area in which the fluid coupling is located.

5. A method according to claim 1, wherein the first and third differentials between the ambient pressure and the pressure in the mooring area are in the range from 10 to 300 kilopascals.

6. A method according to claim 1, wherein the second differential between the ambient pressure and the pressure in the mooring area is in the range from 2 to 50 kilopascals.

7. A method according to claim 1, wherein the displacement of the mooring element from the desired position is detected by a plurality of sensors coupled to the vessel which receive signals from an acoustic transponder coupled to the mooring element.

8. A method according to claim 1, wherein the mooring element is composed of a first portion which, when secured to the bottom surface of the vessel, is non-rotatable with respect to the vessel and a second portion which is rotatable with respect to the vessel.

9. A vessel mooring system, wherein the vessel includes a mooring area formed on a bottom surface of the vessel, the system comprising:

a mooring element coupled to the sea floor by a plurality of mooring tethers wherein, when not moored to a vessel, the mooring element is maintained in a storage position a preselected depth below the surface, an upper surface of the mooring element including a sealing surface surrounding a target area to be coupled within the mooring area;

a retrieval line coupled to the mooring element wherein a portion of the retrieval line floats on the surface;

a winch mounted aboard the vessel for recovering the retrieval line thereby raising the mooring element from the storage position into a mooring position in which the sealing surface is in contact with the bottom surface of the vessel so that the mooring area is sealed between the bottom surface of the vessel and the target area;

a first pump for lowering the pressure between the bottom surface of the vessel and the target area of the upper surface of the mooring element, wherein the first pump operates to produce a first differential between the ambient pressure and the pressure in the mooring area for immobilizing the mooring element with respect to the bottom surface of the vessel and a second differential between the ambient pressure and the pressure in the mooring area, wherein the magnitude of the second pressure differential is smaller than the magnitude of the first pressure differential so that the mooring element is maintained in sliding contact with the bottom surface of the vessel; and an optical imaging device for detecting a displacement of the mooring element from a desired position of the mooring element within the mooring area.

10. A vessel mooring system according to claim 9, wherein the optical imaging system includes a television camera.

11. A vessel mooring system according to claim 11, wherein the mooring element includes a plurality of concentric circles visible on its upper surface.

12. A vessel mooring system according to claim 9, wherein the mooring element includes a light mounted on its upper surface.

13. A vessel mooring system according to claim 9, further comprising a second pump for working with the first pump to create a desired differential between the pressure in the mooring area and the ambient pressure.

14. A vessel mooring system according to claim 9, wherein the first pump includes an outlet separated from the mooring area by a predetermined distance, and wherein the direction of an outflow from this outlet may be oriented at a desired angle to provide a desired force to the vessel.

15. A vessel mooring system according to claim 9, wherein the upper surface of the mooring element includes a fender which comes into contact with the bottom surface of the vessel after the sealing surface has been compressed against the bottom surface of the vessel.

16. A vessel mooring system according to claim 15, wherein the sealing surface is constructed of a first material and the fender is constructed of a second material and wherein the coefficient of friction between the bottom surface of the vessel and the fender is greater than the coefficient of friction between the sealing surface and the bottom surface of the vessel.

17. A vessel mooring system according to claim 16, wherein, when the first differential is applied between the pressure in the mooring area and the ambient pressure, the sealing surface is compressed and the fender is in contact with the bottom surface of the vessel and, when the second differential is applied between the pressure in the mooring area and the ambient pressure, the fender does not contact the bottom surface of the vessel.

18. A vessel mooring system, wherein the vessel includes a mooring area on a bottom surface of the vessel, the system comprising:

a mooring element coupled to the sea floor by a plurality of mooring tethers wherein, when not moored to a vessel, the mooring element is maintained in a storage position a preselected depth below the surface, an upper surface of the mooring element including a sealing surface surrounding a target area to be coupled within the mooring area;

means for raising the mooring element from the storage position into a mooring position in which the sealing surface is in contact with the bottom surface of the vessel so that a sealed mooring area is created between the bottom surface of the vessel and the target area;

a pump for lowering the pressure between the bottom surface of the vessel and the target area of the upper surface of the mooring element, wherein the pump operates to produce a first differential between the ambient pressure and the pressure in the mooring area for immobilizing the mooring element with respect to the bottom surface of the vessel and a second differential between the ambient pressure and the pressure in the mooring area, wherein the magnitude of the second pressure differential is smaller than the magnitude of the first pressure differential so that the mooring element is maintained in sliding contact with the bottom surface of the vessel; and means for detecting a displacement of the mooring element from a desired position of the mooring element within the mooring area.

19. A vessel mooring system according to claim 18, wherein the means for detecting a displacement includes an optical imaging system for observing the upper surface of the mooring element.

20. A vessel mooring system according to claim 18, wherein the means for detecting a displacement includes a mooring element transmitter coupled to the mooring element for transmitting signals indicative of the position of the mooring element and a plurality of sensors coupled to the vessel for receiving the signals from the mooring element transmitter.

21. A vessel mooring system according to claim 20, wherein the mooring element transmitter is an acoustic transponder.

22. A vessel mooring system according to claim 18, wherein the upper surface of the mooring element includes a fender which comes into contact with the bottom surface of the vessel after the sealing surface has been compressed against the bottom surface of the vessel.

23. A vessel mooring system according to claim 18, wherein the target area is an annular area surrounding a central volume in which a fluid coupling between the vessel and the mooring element is located.

24. A vessel mooring system according to claim 23, wherein the central volume includes an outlet through which water in the central volume may be removed.

25. A vessel mooring system according to claim 22, wherein the sealing surface is constructed of a first material and the fender is constructed of a second material and wherein the coefficient of friction between the bottom surface of the vessel and the fender is greater than the coefficient of friction between the sealing surface and the bottom surface of the vessel.

26. A vessel mooring system according to claim 25, wherein, when the first differential is applied between the pressure in the mooring area and the ambient pressure, the sealing surface is compressed and the fender is in contact with the bottom surface of the vessel and, when the second differential is applied between the pressure in the mooring area and the ambient pressure, the fender does not contact the bottom surface of the vessel.

27. A vessel mooring system according to claim 18, wherein the means for raising the mooring element includes a reservoir of compressed gas in fluid communication with a ballast area of the mooring element and a vessel transmitter for sending an activating signal from the vessel to the mooring element for releasing the compressed gas into the ballast area of the mooring element to increase the buoyancy of the mooring element.

28. A vessel mooring system according to claim 27, wherein the conduit for expelling water ballast from the mooring element includes a valve and an actuator controlled by a transmitter on board the vessel.

29. A vessel mooring system according to claim 18, wherein the means for raising the mooring element includes a buoyant retrieval line coupled to the mooring element and a winch aboard the vessel.

30. A vessel adapted for mooring to a submerged mooring element comprising:

a hull with a water intake in a bottom surface of the hull, wherein a first portion of the bottom surface surrounding the water intake is adapted to receive an upper portion of a mooring element coupled to the sea floor by a plurality of mooring tethers;

a pump for rapidly drawing seawater through the water intake out of a mooring area formed between an upper surface of the mooring element and the portion of the hull with which the mooring element is in contact to reduce the downward hydrostatic pressure acting on the upper portion of the mooring element, wherein the pump operates to produce a first differential between the ambient pressure and the pressure in the mooring area for immobilizing the mooring element with respect to the bottom surface of the vessel and operates to produce a second differential between the ambient pressure and the pressure in the mooring area, wherein the magnitude of the second pressure differential is smaller than the magnitude of the first pressure differential, to maintain the mooring element in sliding contact with the bottom surface of the vessel; and a sensor for detecting a displacement of the mooring element from a desired position of the mooring element on the bottom surface of the vessel.

31. A vessel according to claim 30, wherein the vessel includes an outlet for seawater drawn in by the pump which is located remote from the mooring area.

32. A vessel according to claim 31, wherein the remote outlet directs the out-flowing stream of seawater to provide a desired thrust to the vessel.

33. A vessel according to claim 31, further comprising a winch for drawing aboard the vessel a line coupled to the mooring element.

34. A vessel according to claim 31, further comprising a signal generator for transmitting signals to the mooring element to control the buoyancy of the mooring element, thereby controlling the depth at which the mooring element is maintained.

35. A vessel adapted for mooring to a submerged mooring element comprising:

a hull with a water intake formed in a bottom surface of the hull, wherein a first portion of the bottom surface surrounding the water intake is adapted to receive an upper portion of a mooring element which, when not coupled to a vessel, is stored at a preselected depth below the surface of the sea;

a signal generator on board the vessel for generating signals for controlling the depth at which the mooring element is maintained and for raising the mooring element into contact with the bottom surface of the hull;

a pump for rapidly drawing seawater out of the mooring area between an upper surface of the mooring element and the portion of the hull with which the mooring element is in contact to reduce the downward hydrostatic pressure acting on the upper portion of the mooring element, wherein the pump operates to produce a first differential between the ambient pressure and the pressure in the mooring area for immobilizing the mooring element with respect to the bottom surface of the vessel and operates to produce a second differential between the ambient pressure and the pressure in the mooring area, wherein the magnitude of the second pressure differential is smaller than the magnitude of the first pressure differential, to maintain the mooring element in sliding contact with the bottom surface of the vessel; and means for detecting a displacement of the mooring element from a desired position of the mooring element within the mooring area.

36. A vessel according to claim 35, wherein the vessel includes an outlet for seawater drawn in by the pump which is located remote from the mooring area.

37. A vessel according to claim 36, wherein the remote outlet directs the out-flowing stream of seawater to provide a desired thrust to the vessel.

38. A vessel according to claim 35, wherein the means for detecting a displacement provides an optical path for direct visual observation of the mooring element.

39. A vessel according to claim 35, wherein the means for detecting a displacement includes an optical imaging device.

40. A vessel according to claim 35, wherein the means for detecting a displacement includes a plurality of sensors for receiving signals indicative of the position of the mooring element.

* * * * *